US007649542B2

(12) United States Patent
Lee

(10) Patent No.: US 7,649,542 B2
(45) Date of Patent: Jan. 19, 2010

(54) APPARATUS AND METHOD FOR FORMING IMAGE BY DETECTING THERMAL PRINT HEAD TYPE

(75) Inventor: Hyun-Jun Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 542 days.

(21) Appl. No.: 11/188,982

(22) Filed: Jul. 26, 2005

(65) Prior Publication Data

US 2006/0098078 A1 May 11, 2006

(30) Foreign Application Priority Data

Nov. 8, 2004 (KR) ..... 10-2004-0090352

(51) Int. Cl.
*B41J 2/32* (2006.01)

(52) U.S. Cl. ..... 347/171

(58) Field of Classification Search ..... 347/171, 347/189, 192, 194, 211, 59, 50, 19
See application file for complete search history.

(56) References Cited

U.S. PATENT DOCUMENTS 4,591,876 A * 5/1986 Nozaki et al. ..... 347/189
4,741,634 A 5/1988 Nozaki et al.
5,940,095 A 8/1999 Parish et al.
6,076,914 A * 6/2000 Imai ..... 347/19
2003/0002899 A1 1/2003 Furukawa et al.
2004/0036724 A1 2/2004 Masuda et al.

FOREIGN PATENT DOCUMENTS

| | | |
|---|---|---|
| EP | 0 780 236 | 6/1997 |
| JP | 04-062073 | 2/1992 |
| JP | 05-278300 | 10/1993 |
| JP | 07-237306 | 9/1995 |
| JP | 09-169114 A | 6/1997 |
| JP | 10-100395 | 4/1998 |
| JP | 11-192703 | 7/1999 |
| JP | 2001-310503 | 11/2001 |
| JP | 2002-137424 | 5/2002 |

* cited by examiner

*Primary Examiner*—K. Feggins
(74) *Attorney, Agent, or Firm*—Roylance, Abrams, Berdo & Goodman, L.L.P.

(57) ABSTRACT

Provided are an apparatus and method for forming an image by determining a thermal print head type and generating driving signals for driving the thermal print head according to the thermal print head type. The apparatus includes a data input unit which receives data regarding an image to be printed, a controller which determines the thermal print head type and generates driving signals for driving the thermal print head according to the thermal print head type, and the thermal print head which prints the image by heating a medium.

19 Claims, 3 Drawing Sheets

APPARATUS AND METHOD FOR FORMING IMAGE BY DETECTING THERMAL PRINT HEAD TYPE

CROSS-REFERENCE TO RELATED PATENT APPLICATION

This application claims the priority of Korean Patent Application No. 10-2004-0090352, filed on Nov. 8, 2004, in the Korean Intellectual Property Office, the entire disclosure of which is hereby incorporated by reference.

BACKGROUND OF THE INVENTION

1. Field of the Invention

The present invention relates to an apparatus and method for forming an image using a thermal print head that applies heat to a medium. More particularly, the present invention relates to an image forming apparatus and method for detecting the type of thermal print head in an image forming apparatus, generating driving signals according to the thermal print head type, and driving the thermal print head using the driving signals.

2. Description of the Related Art

In recent years, various types of thermal transfer printing apparatuses have been developed to print high-resolution images. A thermal transfer printing apparatus forms an image by transferring ink onto a medium by heating an ink ribbon that contacts a medium or heating an ink layer of a medium to reveal a predetermined color, using the thermal print head.

When driving signals are input to the thermal print head, such as a clock signal, a data signal, a latch signal, and a strobe signal, the thermal print head heats a medium using a plurality of heating units having a predetermined resistance R. The type of thermal print head may differ according to manufacturer. For instance, thermal print heads differ in the number of data lines to which the clock signal and the data signal are input, the bits of data received via a data line, or the characteristics of the heating units. Accordingly, an image compensation table must be selected and driving signals must be generated according to the type of thermal print head in an image forming apparatus. Otherwise, the image quality may be degraded or the image may not be printed.

SUMMARY OF THE INVENTION

The present invention provides an apparatus and method for forming an image by determining the type of thermal print head in an image forming apparatus, generating driving signals according to the thermal print head type, and driving the thermal print head in response to the driving signals.

According to one embodiment of the present invention, there is provided a image forming apparatus with a thermal print head which prints an image by heating a medium, the apparatus comprising a data input unit which receives data regarding an image to be printed, a controller which determines the thermal print head type and generates driving signals for driving the thermal print head according to the thermal print head type, and the thermal print head which prints the image by heating the medium in response to the driving signals.

The thermal print head may be rotated to turn toward a first surface and a second surface of the medium. The controller may receive a determination signal indicating the type of thermal print head from the thermal print head. Using the determination signal, the controller will determine the type of thermal print head, and generate and output driving signals for driving the thermal print head according to the type of the thermal print head. Alternatively, the controller may determine the type of the thermal print head by using a signal output on a data line connected to the thermal print head, and generate and output the driving signals according to the determined type of the thermal print head.

The controller may comprise a memory which stores information regarding various types of thermal print heads, a driving unit which determines the thermal print head type, reads information regarding the thermal print head type from the memory, and generates the driving signals, and an output buffer which outputs the driving signals to the thermal print head under the control of the driving unit.

The information regarding the thermal print head type may specify at least one of the number of data lines of the thermal print head, the number of bits of data received via the data lines, a clock signal, a strobe signal, and an image compensation table.

The driving unit may comprise a thermal print head determination unit which detects a signal on a predetermined one of a plurality of data lines connected to the thermal print head, and determines the thermal print head type accordingly. The driving unit may also comprise a signal generator, which reads the information regarding the thermal print head type from the memory, and generates the driving signals; and a buffer controller, which controls the operation of the output buffer, such that the driving signals are not output to the thermal print head when the thermal print head determination unit is determining the thermal print head type, and are output to the thermal print head after the signal generator generates the driving signals.

However, the predetermined data line may be not available to at least one of the various types of thermal print heads.

The thermal print head determination unit may detect a signal on a predetermined one of the plurality of data lines connected to the thermal print head by pulling up the predetermined data line, and using the detected signal, determine the thermal print head type by checking whether the thermal print head uses the predetermined data line.

According to another embodiment of the present invention, there is provided an apparatus for determining the type of a thermal print head that prints an image by heating a medium, the apparatus comprising a memory which stores information regarding various types of thermal print heads; a driving unit which determines the thermal print head type, reads information regarding the thermal print head type from the memory, and generates the driving signals for driving the thermal print head based on the information regarding the thermal print head type; and an output buffer which outputs the driving signals to the thermal print head under the control of the driving unit.

The driving unit may determine the type of the thermal print head by using a thermal print head determination signal received from the thermal print head, read information regarding the type of the thermal print head from the memory, and generate the driving signals based on the read information.

The driving unit may comprise a thermal print head determination unit which detects a signal of a predetermined one of a plurality of data lines connected to the thermal print head, and determines the thermal print head type using the detected signal; a signal generator, which reads the information regarding the thermal print head type from the memory, and generates the driving signals for driving the thermal print head based on the information regarding the thermal print head type; and a buffer controller, which controls the operation of the output buffer, such that the driving signals are not output to the thermal print head when the thermal print head determination unit is determining the thermal print head type, and are output to thermal print head after the signal generator generates the driving signals.

According to yet another embodiment of the present invention, there is provided a method for forming an image using a thermal print head which prints the image by heating a medium, the method comprising the steps of determining a type of thermal print head in an image forming apparatus; receiving data regarding the image to be printed; generating driving signals which drive the thermal print head, based on the type of thermal print head; and driving the thermal print head to print the image by heating the medium in response to the driving signals.

The thermal print head may be rotated to turn toward a first surface and a second surface of the medium. The step of determining the type of the thermal print head may include receiving a determination signal, which is used to determine the type of thermal print head, from the thermal print head, and determines the thermal print head type.

The step of determining the type of thermal print head may comprise the steps of detecting a signal on a predetermined one of a plurality of data lines of the thermal print head, and determining the type of thermal print head using the detected signal. The predetermined data line may not be not available to at least one of a plurality of thermal print heads whose types are to be determined.

The step of detecting the signal of the predetermined data line may include detecting the signal of the predetermined data line by accessing the predetermined data line.

The method may further comprise the steps of controlling the input of the driving signals to the thermal print head, wherein the driving signals are not input while the type of thermal print head is being determined.

The steps of generating the driving signals may comprise the steps of reading information regarding the type of thermal print head from a memory, which stores information regarding various types of thermal print heads, and generating the driving signals for driving the thermal print head based on the information regarding the type of thermal print head.

The information regarding the thermal print head type may specify at least one of a number of data lines of the thermal print head, the number of bits of data received via a data line, a clock signal, a strobe signal, and an image compensation table.

According to still another embodiment of the present invention, there is provided a computer readable recording medium for storing a program that executes the method on a computer.

BRIEF DESCRIPTION OF THE DRAWINGS

The above and other aspects and advantages of the present invention will become more apparent by describing in detail exemplary embodiments thereof with reference to the attached drawings in which.

It should be understood that throughout the drawings like reference numerals refer to like features, structures and elements.

DETAILED DESCRIPTION OF EXEMPLARY EMBODIMENTS

Hereinafter, an exemplary embodiment of the present invention will be described in detail with reference to the accompanying drawing.

Figure 1:
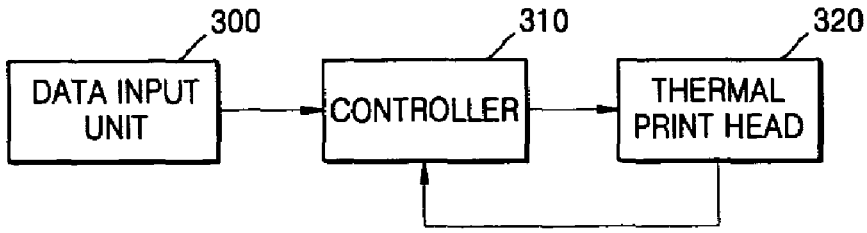
FIG. 1 is a block diagram of an image forming apparatus according to an embodiment of the present invention.

FIG. 1 is a block diagram of an apparatus for forming an image according to an embodiment of the present invention. Referring to FIG. 1, the apparatus comprises a data input unit 300, a controller 310, and a thermal print head 320.

Figure 6:
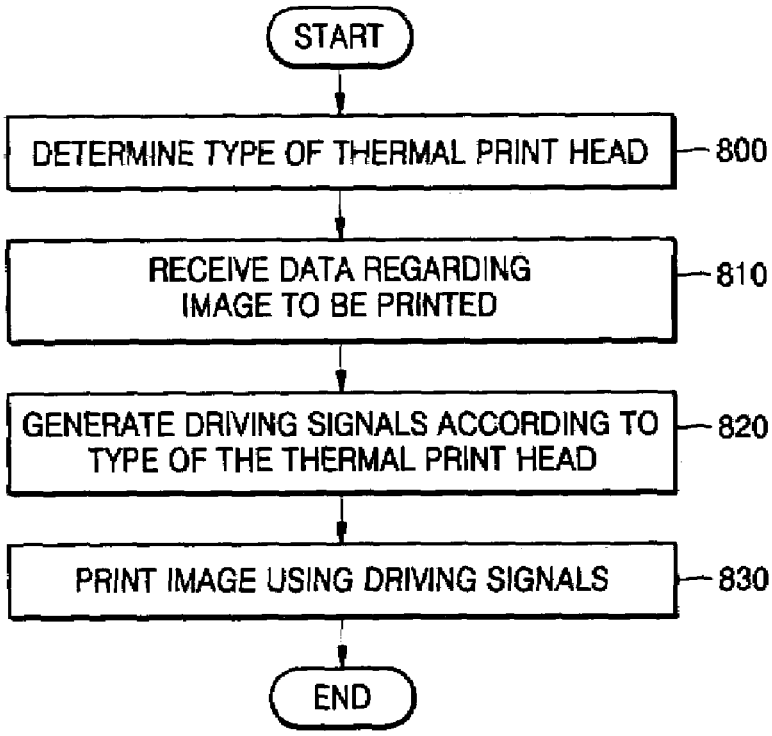
FIG. 6 is a flowchart illustrating a method of forming an image by determining a thermal print head type and generating driving signals for driving the thermal print head according to the thermal print head type, according to an embodiment of the present invention.

The operation of the apparatus will now be described with reference to FIGS. 1 and 6. FIG. 6 is a flowchart illustrating a method of forming an image according to an embodiment of the present invention. Referring to FIG. 6, the controller 310 determines the type of the thermal print head 320 (operation 800). Next, the data input unit 300 receives data regarding an image to be printed, from an external device such as a personal computer (PC) or a digital camera (operation 810). Next, the controller 310 generates driving signals, such as a clock signal, a latch signal, a data signal, and a strobe signal, to drive the thermal print head 320, based on the type of the thermal print head 320, and inputs the driving signals to the thermal print head 320 (operation 820). In operation 820, the controller 310 preferably selects an image compensation table that compensates for errors in an image to be printed using the thermal print head 320 according to the type of the thermal print head 320, and outputs values of the compensation table that are preferably included in a driving signal to the thermal print head 320.

Next, the thermal print head 320 prints the image by heating a medium (not shown) in response to the driving signals (operation 830). The thermal print head 320 is preferably rotated to turn toward first and second surfaces of the medium in order to heat both the first and second surfaces.

Figure 2:
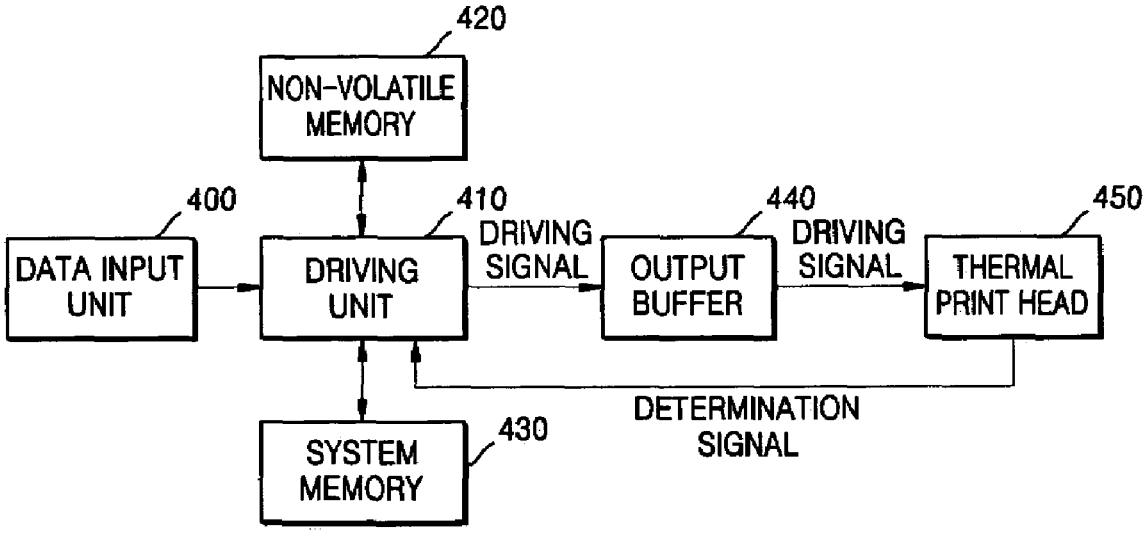
FIG. 2 is a block diagram of an image forming apparatus that determines a thermal print head type and prints an image by generating driving signals based on the type of thermal print head according to an embodiment of the present invention.

FIG. 2 is a block diagram of an image forming apparatus that forms an image by determining the type of a thermal print head 450 and generating driving signals based on the type of the thermal print head 450 according to an embodiment of the present invention. The image forming apparatus comprises a data input unit 400, a driving unit 410, a non-volatile memory 420, a system memory 430, an output buffer 440, and the thermal print head 450. In this embodiment, the inclusion of the output buffer 440 is optional.

The non-volatile memory 420 is a memory which retains data even without a supply of power. The non-volatile memory 420 may alternatively be a Static Random Access Memory (SRAM) attached with a backup battery, an Erasable and Programmable ROM (EPROM), an Electrically EPROM (EEPROM), a mask ROM, or a flash memory. The non-volatile memory 420 preferably stores information regarding the various types of thermal print head that can be installed in the image forming apparatus. The information may specify: (1) the number of data lines; (2) driving signals such as a clock signal, a latch signal, and a strobe signal; (3) bits of data received via a data line; and (4) a thermal print head mapping table that includes an image compensation table.

The data input unit 400 receives data regarding an image to be printed, from an external device (not shown) such as a PC or a digital camera. According to a control program stored in the non-volatile memory 420, the driving unit 410 receives a determination signal that has information about the type of thermal print head 450 from the thermal print head 450 via a signal line, and determines the type of the thermal print head 450. The determination signal is not sent via a data line through which the driving signals are transmitted to the thermal print head 450 via the output buffer 440.

The driving unit 410 reads the appropriate information regarding the thermal print head type and the image compensation table from the non-volatile memory 420, generates the driving signals for driving the thermal print head 450 based on the information regarding the thermal print head type, and outputs the driving signals together with the information regarding the image compensation table.

The output buffer 440 controls the flow of data transmitted from the driving unit 410 to the thermal print head 450, and adjusts the levels of the driving signals generated by the driving unit 410 according to the thermal print head 450. The thermal print head 450 prints the image by heating a medium (not shown) in response to the driving signals received from the output buffer 440.

Figure 3:
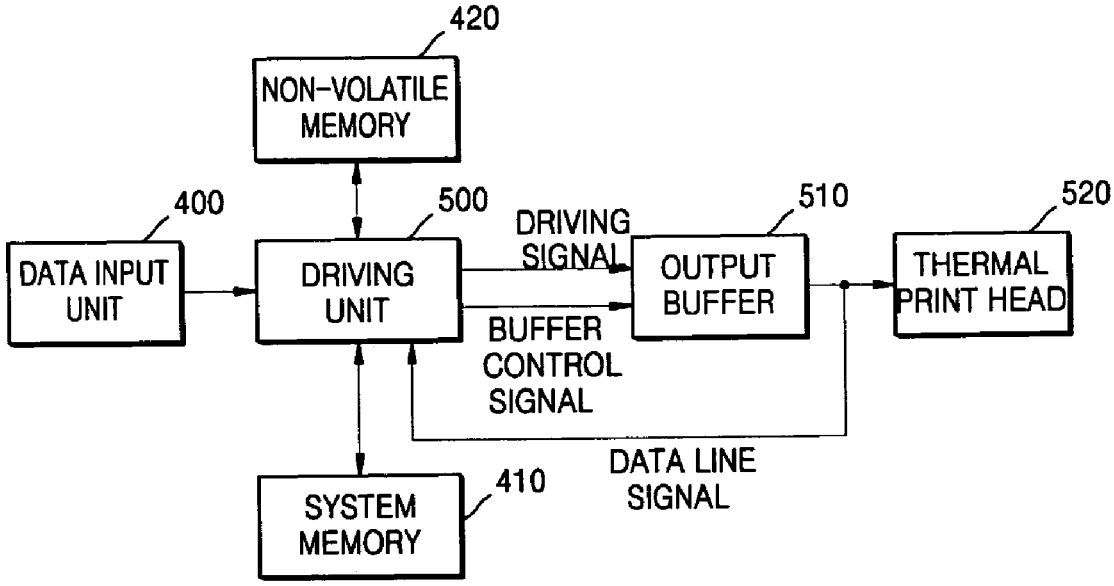
FIG. 3 is a block diagram of an image forming apparatus that determines a thermal print head type and prints an image by generating driving signals based on the type of thermal print head according to another embodiment of the present invention.

FIG. 3 is a block diagram of an image forming apparatus that forms an image by determining the type of thermal print head 520 and generating driving signals according to the type of the thermal print head 520 according to another embodiment of the present invention. The image forming apparatus comprises a data input unit 400, a driving unit 500, a non-volatile memory 420, a system memory 430, an output buffer 510, and the thermal print head 520.

The data input unit 400 receives data regarding an image to be printed from an external device (not shown). According to a control program stored in the non-volatile memory 420, the driving unit 500 detects a signal output from one of the data lines that connect the output buffer 510 to the thermal print head 520, and determines the type of the thermal print head 520 using the detected signal.

To determine whether the thermal print head 520 is an A type or a B type, the driving unit 500 may detect a signal of a data line available to only the A type. Alternatively, the driving unit 500 can determine that the thermal print head 520 is an A type when the data line on which the signal is detected is connected to the thermal print head 520, otherwise, the thermal print head 520 is a B type.

Also, it is possible to determine whether the type of thermal print head 520 is one of three or more other possible types. For instance, to determine whether the thermal print head 520 is an A, B, or C type, the driving unit 500 detects signals of two data lines, using a combination of the signals of the data lines. If a $10^{th}$ data line is available to only the A type and an $11^{th}$ data line is available to the C type, the driving unit 500 detects signals of the $10^{th}$ and $11^{th}$ data lines, but determines that the thermal print head 520 is a C type when the thermal print head 520 is connected only to the $11^{th}$ data line.

The driving unit 500 reads the appropriate information regarding the thermal print head type and an image compensation table from the non-volatile memory 420, generates the driving signals for driving the thermal print head 520 using the information regarding the thermal print head type, and outputs the driving signals together with the information regarding the image compensation table.

Under the control of the driving unit 500, the output buffer 510 adjusts the levels of the driving signals generated by the driving unit 500 and outputs the adjusted driving signals to the thermal print head 520. The driving unit 500 preferably controls the operation of the output buffer 510, such that the driving signals are not output to the thermal print head 520 while detecting a signal output from a selected data line and determining the type of the thermal print head 520. The driving signals are preferably output to the thermal print head 520 after determining the type of thermal print head 520.

The thermal print head 520 prints the image by heating a medium (not shown) in response to the driving signals received from the output buffer 510.

Figure 4:
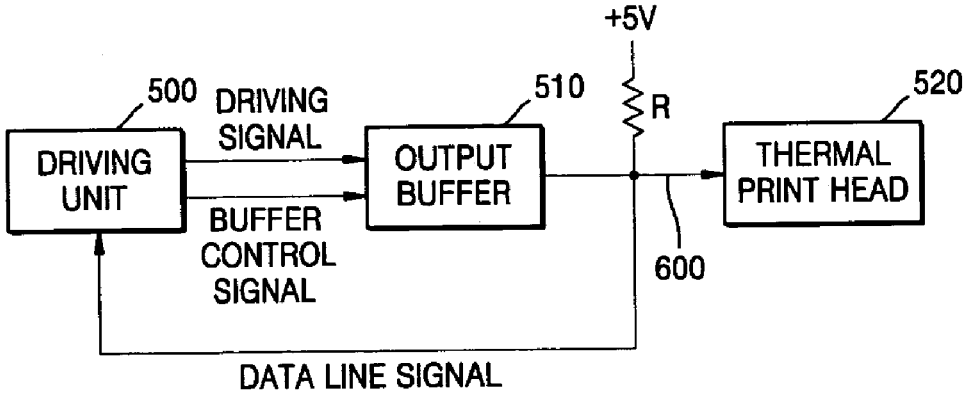
FIG. 4 is a block diagram illustrating a method of detecting a signal output from a data line according to an embodiment of the present invention.

FIG. 4 is a block diagram illustrating a method for detecting a signal output from a data line according to an embodiment of the present invention. Referring to FIG. 4, a signal output from one data line 600 of a plurality data lines, which connect an output buffer 510 to a thermal print head 520, is detected by accessing the data line 600. Specifically, the data line 600 is connected to a thermal print head logic power supply voltage +5V through a pull-up resistor R, and the amplitude of the signal output from the data line 600 is measured. The resistance of the thermal print head 520 is far greater than the resistance of the pull-up resistor R, and thus, when the thermal print head 520 uses the data line 600, the signal output from the data line 600 is at a logic high level. When the thermal print head 520 does not use the data line 600, the data line 600 is connected to a ground voltage GND, and thus, the signal output from the data line 600 is at a logic low level.

Accordingly, the driving unit 500 can determine whether the thermal print head 520 uses the data line 600 by checking the logic level of the signal output from the data line 600.

Figure 5:
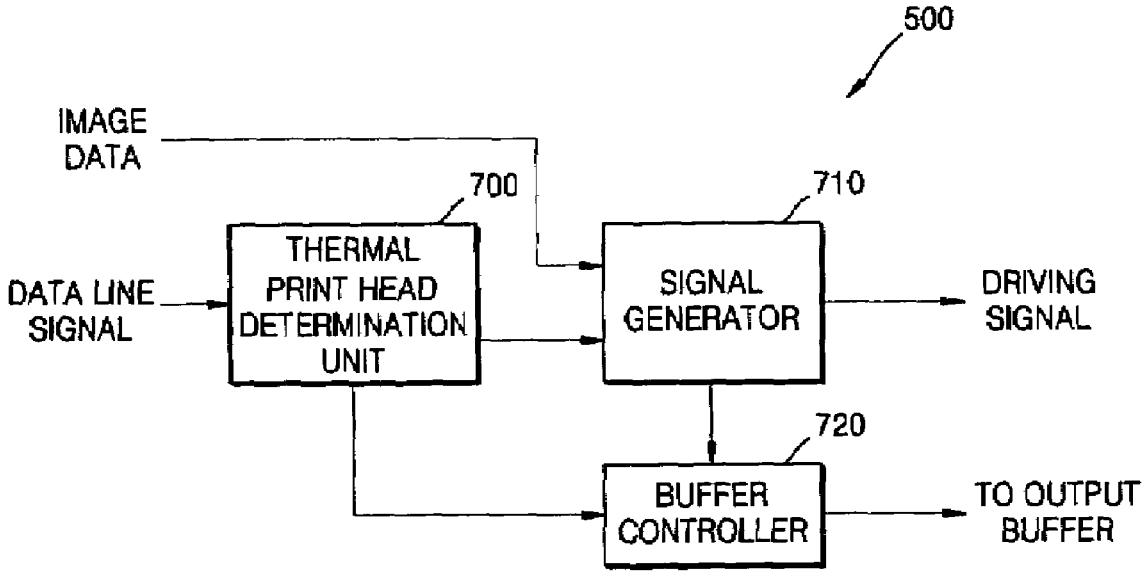
FIG. 5 is a block diagram of a driving unit of FIG. 4.

FIG. 5 is a detailed block diagram of the driving unit 500 of FIG. 4. The driving unit 500 comprises a thermal print head determination unit 700, a signal generator 710, and a buffer controller 720.

The thermal print head determination unit 700 determines the type of the thermal print head 520 using the signal output from the data line 600. The signal generator 710 reads the appropriate information regarding the type of the thermal print head 520 and an image compensation table from the non-volatile memory 420 (as shown in FIG. 3), and generates and outputs the driving signals, such as a clock signal, a data signal, a latch signal, and a strobe signal, which drive the thermal print head 520 (as shown in FIG. 3), based on the information regarding the type of thermal print head 520.

The buffer controller 720 controls the operation of the output buffer 510 (as shown in FIG. 3), such that the driving signals are not output to the thermal print head 520 when the thermal print head determination unit 700 is determining the type of thermal print head 520, and are output to the thermal print head 520 after the thermal print head determination unit 700 has determined the type of thermal print head 520 and the signal generator 710 generates and outputs the driving signals.

As described above, according to embodiments of the present invention, an image is printed by determining the type of thermal print head, and generating driving signals for driving the thermal print head according to the type of thermal print head. Accordingly, it is possible to eliminate the inconvenience caused by requiring a user to check the type of a new thermal print head and to set the thermal print head type whenever a thermal print head is exchanged. Furthermore, errors due to the user incorrectly setting the type of thermal print head are prevented.

The present invention can be embodied as computer readable code in a computer readable medium. Here, the computer readable medium may be any recording apparatus capable of storing data to be read by a computer system, e.g., a read-only memory (ROM), a random access memory (RAM), a compact disc (CD)-ROM, a magnetic tape, a floppy disk, an optical data storage device, and so on. Also, the computer readable medium may be a carrier wave that transmits data via the Internet, for example. The computer readable recording medium can be distributed among computer systems that are interconnected through a network, and embodiments of the present invention may be stored and implemented as computer readable code in the distributed system. A functional program, code, and code segments required to embody the present invention can be easily derived by programmers in the art.

While this invention has been particularly shown and described with reference to exemplary embodiments thereof, it will be understood by those skilled in the art that various changes in form and details may be made therein without departing from the spirit and scope of the invention as defined by the appended claims.

What is claimed is:

1. An image forming apparatus with a thermal print head which prints an image by heating a medium, comprising:

a data input unit which receives data regarding an image to be printed;

a controller which determines the thermal print head type and generates driving signals for driving the thermal print head according to the thermal print head type; and the thermal print head which prints the image by applying heat to the medium in response to the driving signals;

wherein the controller detects a data signal of a data line connected to the thermal print head and determines the thermal print head type based on the detected data signal.

2. The apparatus of claim 1, wherein the thermal print head is rotated to turn toward a first surface and a second surface of the medium.

3. The apparatus of claim 1, wherein the controller receives a determination signal for determining the thermal print head type from the thermal print head, and determines the terminal print head type based on the determination signal.

4. The apparatus of claim 1, wherein the controller comprises:

a memory which stores information regarding various types of thermal print heads;

a driving unit which determines the type of thermal print head, reads information regarding the thermal print head type from the memory, and generates the driving signals based on the read information; and an output buffer which outputs the driving signals to the thermal print head under the control of the driving unit.

5. The apparatus of claim 4, wherein the information regarding the thermal print head type specifies at least one of the number of data lines of the thermal print head, the number of bits of data received via the data lines, a clock signal, a strobe signal, and an image compensation table.

6. The apparatus of claim 4, wherein the driving unit comprises:

a thermal print head determination unit which detects a signal of a predetermined one of a plurality of data lines connected to the thermal print head, and determining the thermal print head type;

a signal generator which reads the information regarding the thermal print head type from the memory, and generates the driving signals; and a buffer controller which controls the operation of the output buffer, such that the driving signals are not output to the thermal print head when the thermal print head determination unit is determining the thermal print head type, and are output to the thermal print head after the signal generator generates the driving signals.

7. The apparatus of claim 6, wherein the predetermined data line is not available to at least one of the various types of thermal print heads.

8. The apparatus of claim 6, wherein the thermal print head determination unit detects a signal of a predetermined one of the plurality of data lines connected to the thermal print head by pulling up the predetermined data line, and, using the detected signal, determines the thermal print head type by checking whether the thermal print head uses the predetermined data line.

9. An apparatus for determining the type of a thermal print head that prints an image by heating a medium, comprising:

a memory which stores information regarding various types of thermal print heads;

a driving unit which determines the thermal print head type, reads information regarding the thermal print head type from the memory, and generates the driving signals for driving the thermal print head based on the information regarding the thermal print head type; and an output buffer which outputs the driving signals to the thermal print head under the control of the driving unit;

wherein the driving unit receives a determination data signal which determines the thermal print head type from the thermal print head, and determines the thermal print head type.

10. The apparatus of claim 9, wherein the driving unit comprises:

a thermal print head determination unit which detects a signal of a predetermined one of a plurality of data lines connected to the thermal print head, and determines the thermal print head type using the signal;

a signal generator which reads the information regarding the thermal print head type from the memory, and generates the driving signals for driving the thermal print head based on the information regarding the thermal print head type; and a buffer controller which controls the operation of the output buffer, such that the driving signals are not output to the thermal print head when the thermal print head determination unit is determining the thermal print head type, and are output to thermal print head after the signal generator generates the driving signals.

11. A method of forming an image using a thermal print head which prints the image by heating a medium, comprising the steps of:

determining a type of the thermal print head;

receiving data regarding the image to be printed;

generating driving signals which drive the thermal print head, according to the thermal print head type; and driving the thermal print head to print the image by heating the medium, in response to the driving signals;

wherein the step of determining the type of the thermal print head comprises the steps of detecting a data signal of a predetermined one of a plurality of data lines of the thermal print head; and determining the thermal print head type using the detected data signal.

12. The method of claim 11, wherein the thermal print head is rotated to turn toward a first surface and a second surface of the medium.

13. The method of claim 11, wherein the step of determining the type of the thermal print head comprises the steps of:

receiving a determination signal, which is used to determine the thermal print head type, from the thermal print head; and determining the thermal print head type.

14. The method of claim 11, wherein the predetermined data line is not available to at least one of a plurality of thermal print heads whose types are to be determined.

15. The method of claim 11, wherein the step of detecting the signal of the predetermined data line comprises the steps of detecting the signal of the predetermined data line by pulling up the predetermined data line.

16. The method of claim 11, further comprising the step of controlling the driving signals not to be input to the thermal print head while determining the thermal print head type.

17. The method of claim 11, wherein the step of generating the driving signals comprises the steps of:

reading information regarding the thermal print head type from a memory which stores information regarding various types of thermal print heads; and generating the driving signals for driving the thermal print head based on the information regarding the thermal print head type.

18. The method of claim 17, wherein the information regarding the thermal print head type specifies at least one of the number of data lines of the thermal print head, the number of bits of data received via a data line, a clock signal, a strobe signal, and an image compensation table.

19. A computer readable recording medium storing a program executed by a computer comprising the steps of:

determining a type of the thermal print head;

receiving data regarding the image to be printed;

generating driving signals which drive the thermal print head based on the thermal print head type; and driving the thermal print head to print the image by heating the medium, in response to the driving signals;

wherein the step of determining the type of thermal print head comprises the steps of:

detecting a data signal of a predetermined one of a plurality of data lines of the thermal print head; and determining the thermal print head type using the detected data signal.

* * * * *

UNITED STATES PATENT AND TRADEMARK OFFICE

CERTIFICATE OF CORRECTION

PATENT NO. : 7,649,542 B2
APPLICATION NO. : 11/188982
DATED : January 19, 2010
INVENTOR(S) : Hyun-Jun Lee It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 804 days.

Signed and Sealed this

Twenty-third Day of November, 2010

David J. Kappos

David J. Kappos
*Director of the United States Patent and Trademark Office*